United States Patent [19]

Lee

[11] 4,293,997

[45] Oct. 13, 1981

[54] METHOD FOR MANUFACTURE OF ARTIFICIAL FLOWERS

[76] Inventor: Bobby L. Lee, 5, Mok Cheong St., ground floor, block C, Kowloon, Hong Kong

[21] Appl. No.: 94,174

[22] Filed: Nov. 14, 1979

Related U.S. Application Data

[60] Division of Ser. No. 925,705, Jul. 18, 1978, which is a continuation-in-part of Ser. No. 790,016, Apr. 22, 1977, abandoned.

[51] Int. Cl.[3] ..... B23P 11/02

[52] U.S. Cl. ..... 29/450; 29/458; 29/460; 264/271.1

[58] Field of Search ..... 29/458, 460, 450; 428/15, 24, 25, 26; 264/271

[56] References Cited

U.S. PATENT DOCUMENTS

| | | | |
|---|---|---|---|
| 1,748,636 | 2/1930 | Crockett | 428/26 |
| 2,344,575 | 3/1944 | Warren | 264/271 X |
| 2,514,177 | 7/1950 | Brown | 428/24 X |
| 2,553,953 | 5/1951 | Arkinstall | 428/24 X |
| 2,879,617 | 3/1959 | Popeil | 428/24 X |
| 3,041,766 | 7/1962 | Decamp | 428/24 |
| 3,137,610 | 6/1964 | Flynn | 428/26 |
| 3,146,153 | 8/1964 | Stein | 428/26 |
| 3,644,164 | 2/1972 | Chin | 428/26 X |
| 3,711,696 | 1/1973 | Sieloff | 428/24 X |
| 3,793,126 | 2/1974 | McAdams | 428/24 |

*Primary Examiner*—Charlie T. Moon

*Attorney, Agent, or Firm*—Owen, Wickersham & Erickson

[57] ABSTRACT

An artificial flower assembly is made from a plastic stem unitarily molded around a reinforcing wire with integral side petioles (preferably wire reinforced) and an integral calyx and with a coupling member also integral therewith. The coupling member may be a stud having an enlarged terminal portion extending beyond the base of the calyx, or it may be a socket in the base of the calyx. Fabric leaves, in some species preferably with brown edging and impressed veining, are adhered to the petioles. A subassembly of fabric petals, preferably silk printed for veining where appropriate, is made by loosely mounting the petals on a plastic member, preferably tubular. The tubular member is then mounted on the coupling member. For example, it may be pushed on the stud until the enlarged terminal portion lies beyond the end of the tubular member, or it may be inserted in the socket, if that is used instead of the stud.

11 Claims, 12 Drawing Figures

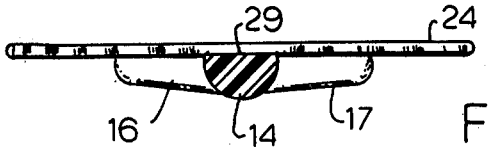
FIG. 9
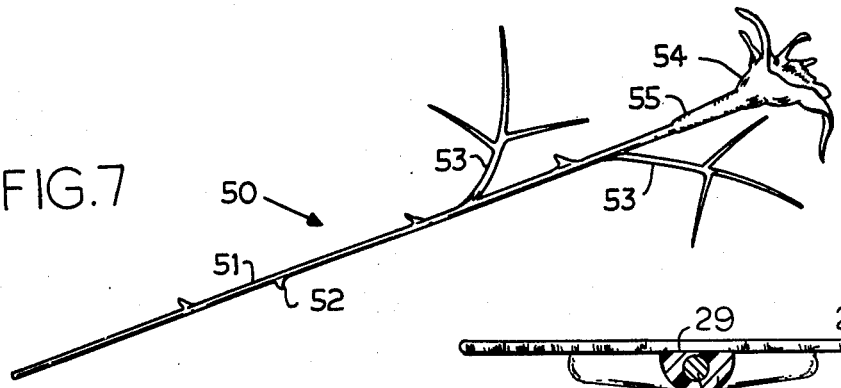
FIG. 7
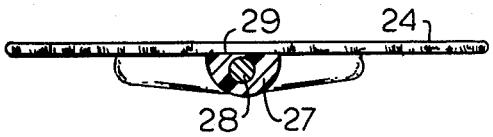
FIG. 12
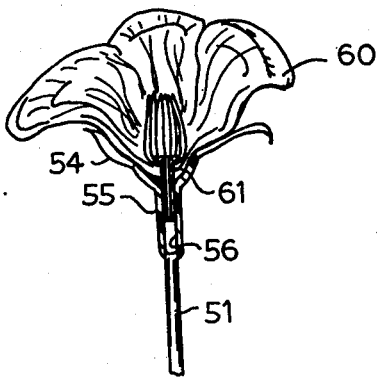
FIG. 8
FIG. 11
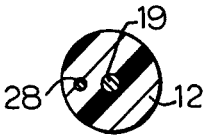
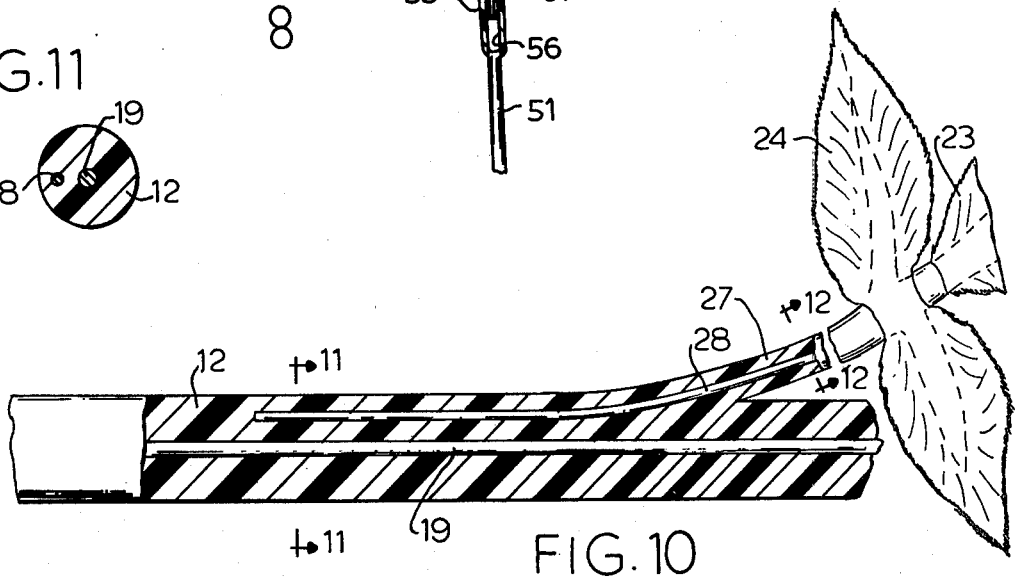
FIG. 10

ARTIFICIAL FLOWERS AND METHOD FOR THEIR MANUFACTURE, UNISTEM

Reference to Related Application

This is a division of application Ser. No. 925,705 filed July 18, 1978 which was a continuation-in-part of Ser. No. 790,016 filed Apr. 22, 1977, now abandoned.

BACKGROUND OF THE INVENTION

This invention relates to artificial flowers and to an improved method for their manufacture.

It is often desirable for artificial flowers to look very much like the real ones, and it is also desirable that they be relatively inexpensive, long lasting, able to stay fully assembled, and of pleasing lifelike appearance.

Many methods have been used for making artificial flowers, but one that has recently come into use involves first, molding an artificial stem, which may be provided with little projections to simulate thorns and little studs sticking out at the edge; second, sprigs or petioles are separately molded, having a little coupling member that is joinable to the projections from the stem; third, artificial leaves precut from suitable material are adhered to the separate petioles. Only after this are the petioles with the leaves on them mounted on the molded stem as a fourth step. Fifth a calyx is separately molded from plastic and must be assembled onto the stem by hand. Sixth, precut flower petals are assembled on a suitable jig and then that assembly is attached to a stem portion that extends through and beyond the calyx. Thus, this previous method has required the molding of at least four separate plastic parts in order to provide the stem and calyx assembly, that is, a main stem having a plurality of petioles and a calyx. After the artificial leaves have been put on the petioles, these four parts are assembled into one part and then the flower subassembly is added. All this takes time and requires various processes of handwork to assemble each stem and flower assembly and therefore costs money.

Moreover, with this method of assembly, the petioles can rather easily come off the stem, especially if faultily or carelessly installed; even if correctly installed a very slight pulling action on them will take them off the stem. Also, the calyx being loose, handling of the calyx in a direction tending to move it off the stem causes the flower assembly to fall off and become disassembled. During what may be a long journey from the manufacturer to the distributors and from them to retailers, leaves and blooms have often become loose and come apart from the assemblies.

OBJECTS OF THE INVENTION

Among the objects of the present invention are to provide artificial flower assemblies that are more unitary, that require fewer steps of assembly, and hold together better.

Another object is to provide more decorative, lifelike artificial flowers and leaves.

Another object of the present invention is to provide a method and system that can be used to make artificial roses whether full open, small bud, or medium open, and is also to make various artificial flowers, especially artificial-silk, including several kinds of poppies, poinsettias, various types of chrysanthemums, carnations, marigolds, asters, dahlias, zinnias, and tuberous begonias.

Other objects and advantages of the invention will appear from the following description.

SUMMARY OF THE INVENTION

An artificial flower assembly of this invention is built up on a plastic stem unitarily molded around a reinforcing wire core and having integral side petioles and an integral calyx and also a coupling or attachment means for securing it to a flower subassembly. The coupling or attachment means may be a stud having an enlarged terminal portion extending through or beyond the base of the calyx, or it may be a socket at the base of the calyx. Pre-cut, preferably fabric, leaves are then adhered to the petioles. In the meantime, a subassembly of petals, preferably artificial-silk fabric, is made by loosely mounting pre-cut artificial-silk petals on a central plastic member, preferably tubular. The central member is then coupled to the stem. When the coupling member is a stud, the stud's enlarged terminal portion extends beyond the central member, so that accidental removal of the subassembly is prevented. When the coupling or attachment means is a socket, the central member is pushed into it until it is locked there.

Preferably, the leaves are overall green with, for some species, a brown edging. They may be pressed to provide veining.

For some species of flowers, the petals are preferably printed with a pattern looking like veins.

BRIEF DESCRIPTION OF THE DRAWINGS

In the drawings:

FIG. 7 is a view similar to FIG. 2 of a modified form of the invention.

FIG. 8 is a view similar to FIG. 6 of the form of the invention shown in FIG. 7.

FIG. 9 is an enlarged view in section, taken along the line 9—9 in FIG. 3.

FIG. 10 is a fragmentary enlarged view in elevation and partly in section of a portion of a stem and of a petiole.

FIG. 11 is a view in section taken along the line 11—11 in FIG. 10.

FIG. 12 is a view in section taken along the line 12—12 in FIG. 10.

DESCRIPTION OF SOME PREFERRED EMBODIMENTS OF THE INVENTION

Figure 1:
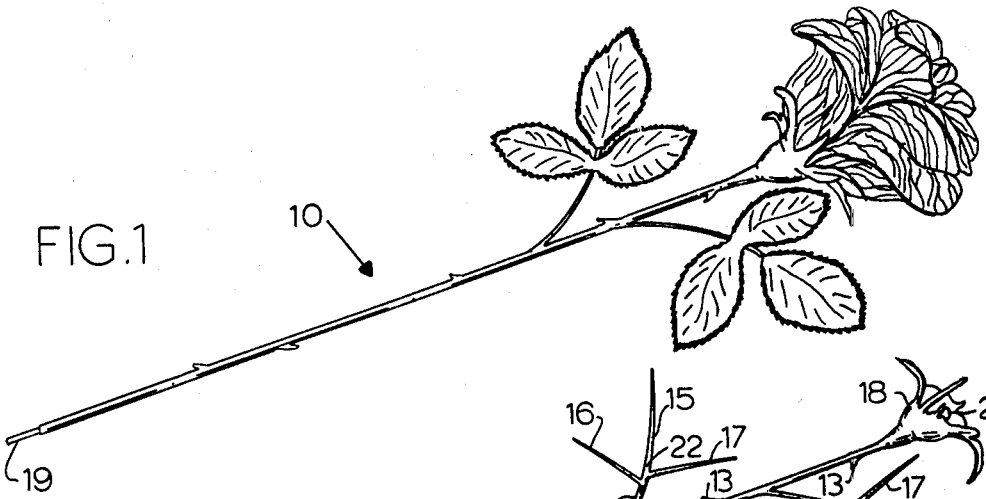
FIG. 1 is a view in side elevation of an artificial flower embodying the principles of the invention and shown in its fully assembled state.
Figure 2:
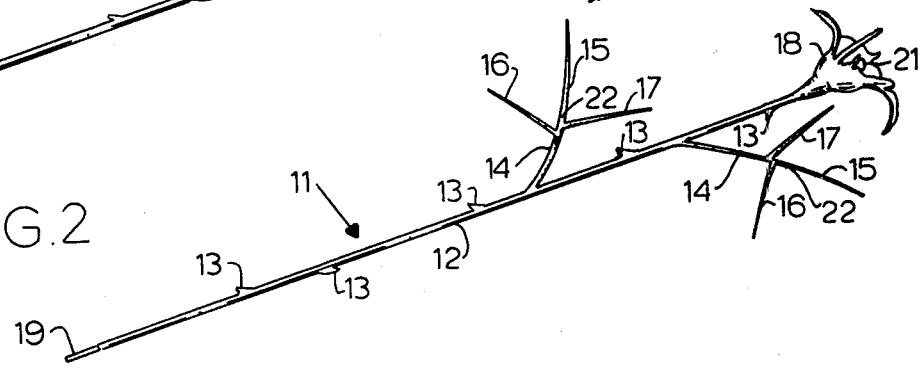
FIG. 2 is a similar view of the main molding of the invention which includes the unitary stem with a plurality of unitary petioles molded to it and with it, and a calyx molded with it and to it. In this form of the invention, the stem has a stud for attachment of a flower subassembly.
Figure 3:
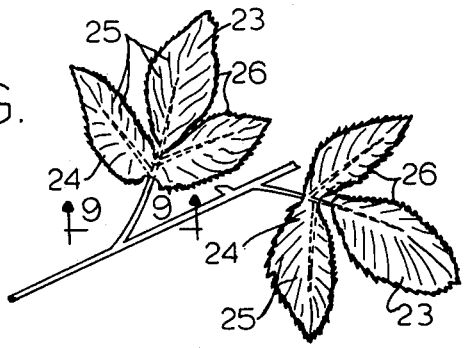
FIG. 3 is a fragmentary view of a portion of the stem of FIG. 2 with the leaves applied to the petioles.
Figure 6:
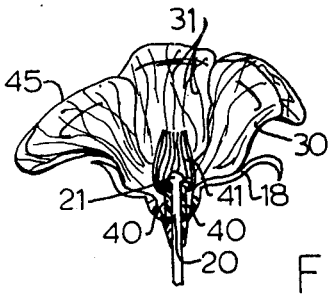
FIG. 6 is a cutaway view of the flower assembly of FIG. 5 attached to the stem of FIG. 2.

A completely assembled artificial flower embodying the principles of the invention is shown at 10 in FIG. 1. As shown in FIG. 2 the assembly 10 is made from a "UNISTEM", a novel unitarily molded member 11 which includes a stem 12 having integrally molded thorns 13 and also integrally molded petioles 14. In the particular member shown, each petiole 14 has a main petiole stem 15 and two side petioles 16 and 17. This unitary molded part also includes a calyx 18 that is molded at the same time as the stem 12 and is molded directly to it. The stem 12 is reinforced by a wire core 19, around which it is molded, while the petioles 14 may be unreinforced, as shown in FIG. 9. Preferably, however, as shown in FIGS. 10–12, the invention employs petioles 27 reinforced by a wire core 28. The petiole wires 28 extend parallel to the wire core 19 for a substantial distance, and are molded into the stem 12 as well as into the petiole 27. The unitarily molded member 11 also includes an attachment means, which in this embodiment comprises a stud 20 shown better in FIG. 6, where it will be seen that the stud is a continuation of the stem 12 beyond the base of the calyx 18 and that the stud 20 has an enlarged terminal portion 21.

There are several advantages in having the member 11 made as a single molding around a wire core. For one thing, it enables consistency in material, whereas in stems made heretofore by assembly, the petioles are often somewhat different in color from the main stem and therefore do not look as real, and the calyx is quite often a different color from either one of them, which again, does not look appropriate. By having them all molded at once as a single injection, preferably in polyvinyl chloride or similar plastic, it is possible to obtain a uniformity heretofore lacking, which adds to the lifelikeness of the whole.

Another important advantage obtained by the invention is that it saves three assembly operations and three additional molding operations. In other words, if one calyx and two petioles were to be used, as here, then each petiole had to be separately molded, and the calyx had to be separately molded and then these molded elements had to be assembled onto the stem. Being assembled meant that they were also liable to come loose or could be readily taken off, and sometimes they came off accidentally. Also, having been separately molded, usually by separate employees or else at separate times, they then had to be assembled by people putting them together by hand. Of course, if there are more than two petioles or more than one calyx, the invention makes manufacture even more economical. The original mold is not difficult to make, and injection molding being what it is today presents no problem to a reasonably skilled molder.

Stems, petioles, and calyx are typically somewhat waxy and may look very real in properly colored plastic. However, leaves are not usually as waxy as the stems and therefore in most instances it is probably better to make them from fabric; although, of course, they can be made from plastic where appropriate. They can readily be secured to the petioles, which preferably have a flat upper surface 22 and a rounded surface on the other side, so that the leaves are readily secured to them as by heat or glue. Preferably, the leaves are made in a manner appropriate to the species. For example, in the artificial rose shown in the drawings, there is an end leaf 23 and a unit 24 comprising a pair of leaves, one for each of the petioles 16 and 17. These can be cut out by suitable machine dies from appropriate dyed fabric. They may be impressed with suitable veining patterns 25. After the leaves have been cut out and before assembly, it is preferred to provide edging on rose leaves and on the leaves of some other species. This may be done by placing some of the leaf elements 23 and 24 into a centrifuge having a small amount of dye in a well; then, as the centrifuge spins and the dye passes to the outside portion, the outside portions or edge portions 26 of the leaf elements 23 and 24 are coated with a reddish brown edging appropriate to roses. The exact color may be a brighter red or a browner red, as desired. Leaves for other kinds of flowers are naturally somewhat different and are made appropriate to the kind of plant imitated. The use of the pair of leaves on the two petioles is economical in assembly time, also. In some flowers, it will be appropriate to make all of the leaves that go on the sprig at one time. In some others where there are no leaves close to the blossom, the molding of suitable sprigs to the main stem is probably enough.

The flower petals 30 are, of course, made suitable to the species of flower being imitated. In roses, and in some other flowers, there is a faint vein pattern in the real flowers that is not reproduced when artificial flowers have only a solid color on the petals. In the present invention, veining is easily applied. Also in some roses, there is a variation as there is in some other flowers, and this too can be made by the present invention. For this purpose, a piece of cloth, preferably artificial silk and usually an entire bolt, is first dyed an appropriate color, such as pink, yellow, red, white, according to the particular flower sought to be imitated. Care is taken, of course, that the color be an appropriate color for the flower, not too strong unless the flower is of the kind that has a strong color, and of a shade of hue that resembles the real flower. Then, on this dyed artificial-silk cloth after the dye has set and dried, an overprinting 31 is applied to resemble veins or variegation or both. This may be done by using a subdued shade of an appropriate color such as a brownish yellow for yellow flowers, a somewhat brownish pink for the pink flowers, and so on. A suitable pattern is prepared in a rolled type press, and the cloth may be passed through that with the pattern being repeated on and on and on.

Figure 4:
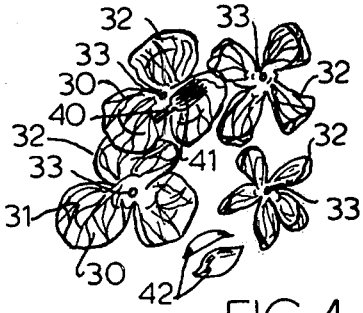
FIG. 4 is a view of cloth petals from which a flower is to be assembled, along with a molded stamen or flower organ member.

The next thing is to cut out petal groups 32 from the printed fabric, as by suitable dies and in well known manner. FIG. 4 shows some of the petal groups 32 after they have been cut from the sheet. It will be seen that some groups 32 have four petals 30 and some three, and that all of the groups 32 have a central opening 33 which is used during assembly and attachment. This is generally considered superior to printing one petal at a time. Here again fabric, especially artificial silk, is generally better than plastic, although if necessary or desirable plastic can be similarly colored and printed.

Figure 5:
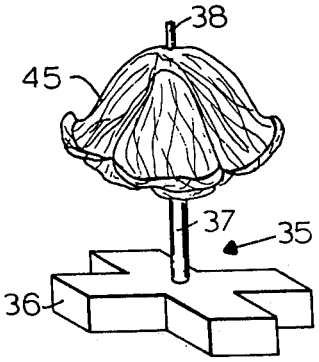
FIG. 5 shows a flower assembled on a jig.

FIG. 5 shows a jig 35 that may be used for making such flower assemblies. The jig 35 has a stand 36 and an upstanding rod 37 having a shoulder (not visible) joining the large diameter rod 37 to an upper small-diameter portion 38. A tubular central plastic member 40, shown in FIG. 6, which may be provided with stamens 41 (or assembled with a separate molding 42 of stamens or other flower organs). The flower organs 41 or 42 may have colored tips appropriate, with the main portion being white or green, as needed. For roses, white stamens with yellow ends are appropriate. The length of the tubular member 40 is related to the length of the stud 20 which extends beyond the calyx. The member 40 rests on the shoulder of the rod 37, and the flower petals are put on upside down around and on the central tubular member 40. Each petal group 32 is put on in an order which is predetermined by the type of flower and the size of the petals 30. When a flower assembly 45 is completely stacked, there is no need to secure it together as a unit; it can instead be directly applied to the member 11. The tubular member 40 is pushed along the stud 20 and forced in until the enlarged terminal portion 21 of the stud 20 is beyond the end of the central tubular member 40. This enlarged portion 21 then locks the stud 20 and member 40 together so that the flower assembly 45 cannot be taken off accidentally but only purposefully.

FIGS. 7 and 8 show a modified form of the "UNISTEM" invention having a main unitary molded plastic member 50. The member 50 includes a stem 51 having integrally molded thorns 52, and integrally molded petioles 53 and an integrally molded calyx 54. The calyx 54 is in this instance provided with a hollow base portion 55 having a circular cylindrical socket 56 therein. As can be seen in FIG. 8, a flower subassembly 60 is supported on a central member 61 which is preferably tubular, and this member 61 fits snugly in the socket 56 and is locked to it by simple pressure, the tubular form of the member 61 helping in this regard.

Thus both members 11 and 50 provide coupling means-- the attachment means 20 and 21 and the socket 56--for cooperation with a central member 40 or 61, which is preferably tubular. Both members 11 and 50 are made as a single plastic member, thereby reducing assembly time.

It will be seen that the number of separate operations has been drastically reduced by this invention and that the assembly itself is improved due to the unitary nature of the member comprising the stems, petioles, and calyx, looking more lifelike and holding together better and without having any of the unrealistic-looking enlargements that were necessary when the petioles had to be attached to the stem in a separate assembly. Moreover, the edging of the leaves and the veining of the petals add to the lifelike nature of the flowers having these characteristics.

As shown in FIGS. 9 and 12, the petiole 14 or 27 is generally molded to have a mostly round cross section with a flat upper surface 29, which helps to provide a good surface for engagement with the leaf unit 24 and the leaf 23, making it easier to secure them together and holding them together over a wider area.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A method for making artificial flowers, comprising:

molding around a reinforcing wire core and as one single integral plastic unit a stem with fully developed side petioles and flower calyx and a coupling means within said calyx, securing pre-cut artificial leaves to said petioles, assembling pre-cut flower petals about a tubular central member to make a flower, and joining the flower to the plastic unit by forcing the central member into locking engagement with the coupling means.

2. The method of claim 1 wherein said leaves are made by cutting appropriate shapes from green-dyed fabric, and applying brown dye to their edges only.

3. The method of claim 2 wherein said brown dye is applied by centrifuging the dye and leaves together.

4. The method of claim 1 wherein said petals are made by dyeing a fabric sheet an appropriate color, overprinting a vein or variegation pattern on said sheet, and then cutting out petal groups joined by a web having a central opening therethrough.

5. The method of claim 1 comprising, prior to said molding step the step of emplacing the stem's wire core and laying short petiole wires with a portion parallel to said wire core and a portion that diverges therefrom.

6. The method of claim 1 comprising, in said molding step, molding said petioles with a round cross-section and a flattened upper surface and then later securing said leaves to said flattened surface.

7. A method for making artificial flowers, comprising:

molding around a reinforcing wire core, as one single integral plastic unit, a stem with side petioles and flower calyx and attachment means surrounded by said calyx, securing pre-cut artificial leaves to said petioles, and attaching a preassembled artificial flower to said attachment means.

8. The method of claim 7 wherein said leaves are made by cutting appropriate shapes from green-dyed fabric, and applying a brown edging thereto.

9. The method of claim 7 wherein said flowers are made by:

dyeing a fabric sheet an appropriate color, overprinting a vein or variegation pattern on said sheet, then cutting out petal groups joined by a web having a central opening therethrough, and assembling petal groups on a coupler member that holds them together and which is readily joined to said attachment means.

10. A method for making artificial flowers, comprising:

molding around a wire core as one single integral plastic unit, a stem with fully developed side petioles and flower calyx and a stud extending through said calyx and terminating in an enlarged end portion, securing pre-cut artificial leaves to said petioles, assembling pre-cut flower petals about a tubular central member to make a flower, and joining the flower to the plastic unit by forcing the central member down around said stud until the enlarged end portion extends fully beyond said central member.

11. A method for making artificial flowers, comprising:

molding around a wire core, as one single integral plastic unit, a stem with fully developed side petioles and flower calyx and a socket within and at the base of said calyx, securing pre-cut artificial leaves to said petioles, assembling pre-cut flower petals about a tubular central member to make a flower, and joining the flower to the plastic unit by forcing the central member down into said socket until the tubular member is firmly locked in said socket.

* * * * *